US007087825B2

(12) United States Patent
Izen et al.

(10) Patent No.: US 7,087,825 B2
(45) Date of Patent: Aug. 8, 2006

(54) MUSICAL INSTRUMENT SYSTEM

(75) Inventors: Mark S. Izen, Chestnut Hill, MA (US); Gerard Helfrich, Somerville, MA (US)

(73) Assignee: First Act Inc., Boston, MA (US)

( * ) Notice: Subject to any disclaimer, the term of this patent is extended or adjusted under 35 U.S.C. 154(b) by 34 days.

(21) Appl. No.: 10/880,773

(22) Filed: Jun. 24, 2004

(65) Prior Publication Data

US 2005/0284284 A1 Dec. 29, 2005

(51) Int. Cl.
*G10D 13/02* (2006.01)

(52) U.S. Cl. ..... 84/411; 248/295.11

(58) Field of Classification Search ..... 84/411, 84/421, 422, 327, 426; 248/295.11
See application file for complete search history.

(56) References Cited

U.S. PATENT DOCUMENTS

| | | | | |
|---|---|---|---|---|
| 4,185,808 | A * | 1/1980 | Donohoe et al. | 248/295.11 |
| 4,279,189 | A * | 7/1981 | Kelly | 84/421 |
| 4,337,684 | A * | 7/1982 | Le Mert | 84/421 |
| 6,075,190 | A * | 6/2000 | Mosser et al. | 84/421 |
| 6,211,448 | B1 * | 4/2001 | Shigenaga et al. | 84/411 R |

* cited by examiner

*Primary Examiner*—Marlon T. Fletcher
*Assistant Examiner*—Jianchun Qin
(74) *Attorney, Agent, or Firm*—John E. Toupal; Harold G. Jarcho

(57) ABSTRACT

A musical instrument system including a drum having a head defining at least one hole; a mounting device including an anchor portion received by the one hole, a collar portion engaging the head, and a receiver portion; a securing mechanism for securing the mounting device to the head; and a connector mechanism for attaching a musical instrument to the mounting device.

17 Claims, 4 Drawing Sheets

MUSICAL INSTRUMENT SYSTEM

BACKGROUND OF THE INVENTION

This invention relates generally to musical instrument systems, and more particularly, to a musical instrument arrangement including a plurality of drums.

Typical drum sets include bass, tom and snare drums together with a cymbal arranged for play by a drummer. The bass drum generally is supported on a floor surface and played with a foot pedal while the other instruments are supported at elevated levels that facilitate comfortable play by the drummer. Conventional hardware used to support the instruments is rather bulky and laborious to set up.

The object of this invention, therefore, is to provide an improved, simple to assemble drum set-up system.

SUMMARY OF THE INVENTION

The invention is a musical instrument system including a drum having a head defining at least one hole; a mounting device including an anchor portion received by the one hole, a collar portion engaging the head, and a receiver portion; a securing mechanism for securing the mounting device to the head; and a connector mechanism for attaching a musical instrument to the mounting device. The use of a drum as a support set-up provides a compact, easily assembled musical instrument system.

According to a certain feature of the invention, the receiver portion projects externally from the head and defines a bore receiving the connector mechanism, the head further defines a cavity disposed adjacent to the hole, and the collar defines a nipple projecting into the cavity so as to prevent rotation of the mounting device in the hole. These features simplify assembly of the system.

According to another feature of the invention, the receiver portion further defines an aperture into the hole, and the connector mechanism includes a rod received by the bore and a set screw extending through the aperture into engagement with the rod. These features facilitate assembly of the system's components in desirable positions.

According to further features of the invention, the collar engages an outer surface of the head, the receiver portion projects externally thereof, and the cavity and nipple are disposed so as to establish an upwardly facing position for the aperture. These features simplify assembly by disposing mounting hardware in easily accessible locations.

According to still other features of the invention, the connector mechanism further includes a handle projecting from the set screw, and the anchor portion is threaded and the securing mechanism includes a nut rotatable on the anchor portion into contact with an inner surface of the head. These features further simplify assembly and alignment of the system's components.

In one embodiment of the invention, the drum head defines a plurality of holes; and the system includes a plurality of mounting devices, one received by each of the holes, a securing mechanism for securing each of the mounting devices, and a connector mechanism for attaching a musical instrument to each mounting device. In this embodiment the drum multiple instruments can be mounted easily on a single support drum.

According to one feature of the above embodiment, the musical instruments include a plurality of drums each having a head defining a hole and a mounting device with a receiver portion attached to a different one of the connector mechanisms. The feature facilitates assembly and use of a typical drum set.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
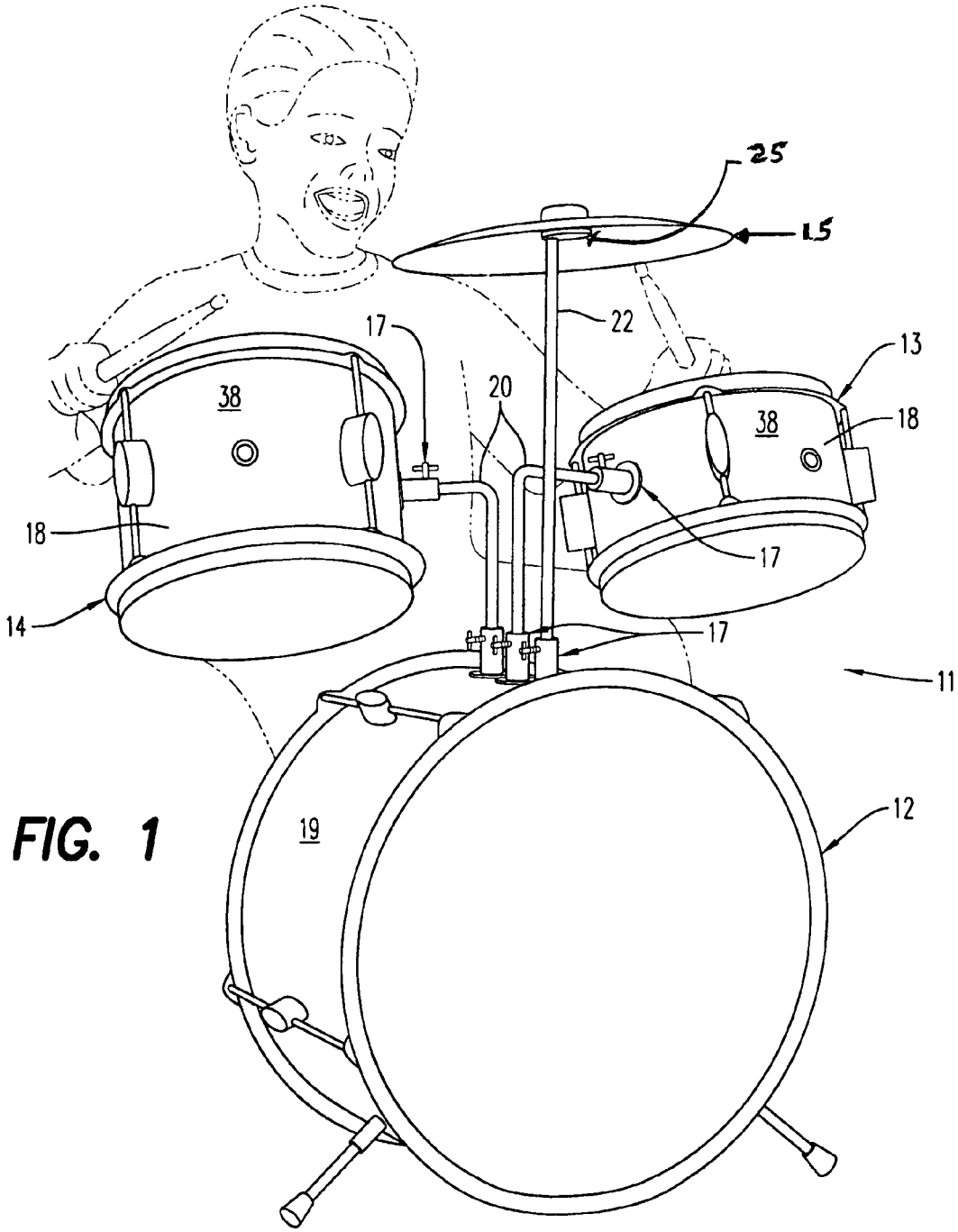
FIG. 1 is a front perspective view of a drum set-up system according to the invention.

A musical instrument set-up system 11 illustrated in FIG. 1 includes a bass drum 12, a snare drum 13, a tom drum 14 and a cymbal 15. Also included are mounting devices 17, one secured to a shell 18 of each of the snare and torn drums and three secured to a shell 19 of the bass drum 12. Angular connector rods 20 of connector mechanisms 21 extend between mounting devices 17 on the bass drum 12 and each of the snare and tom drums 13, 14. Another straight connector rod 22 extends between a third mounting device 17 on the bass drum 12 and a coupling 25 on the cymbal 15.

Figure 2:
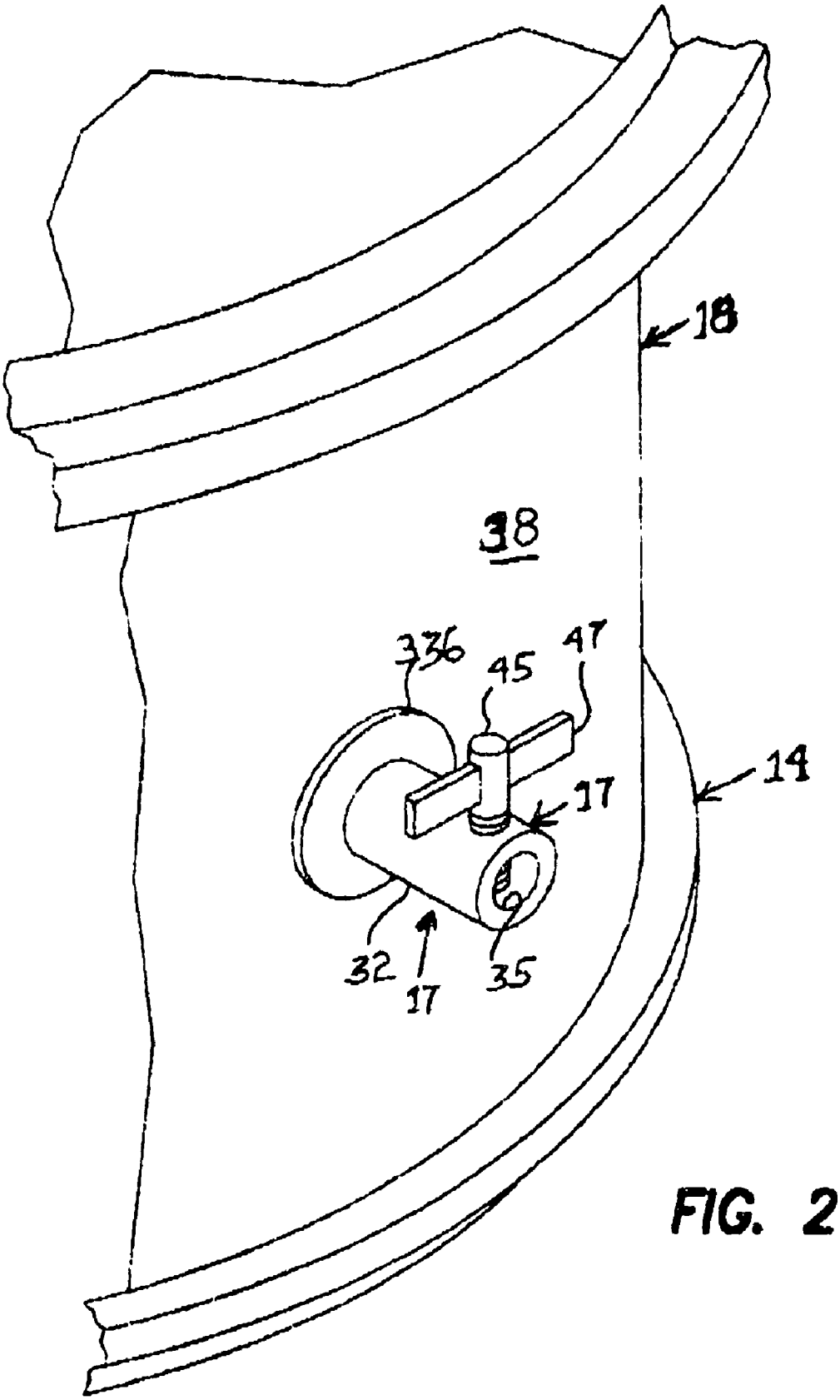
FIG. 2 is a cut-away perspective view showing a drum supported mounting device used in the system of FIG. 1.
Figure 3:
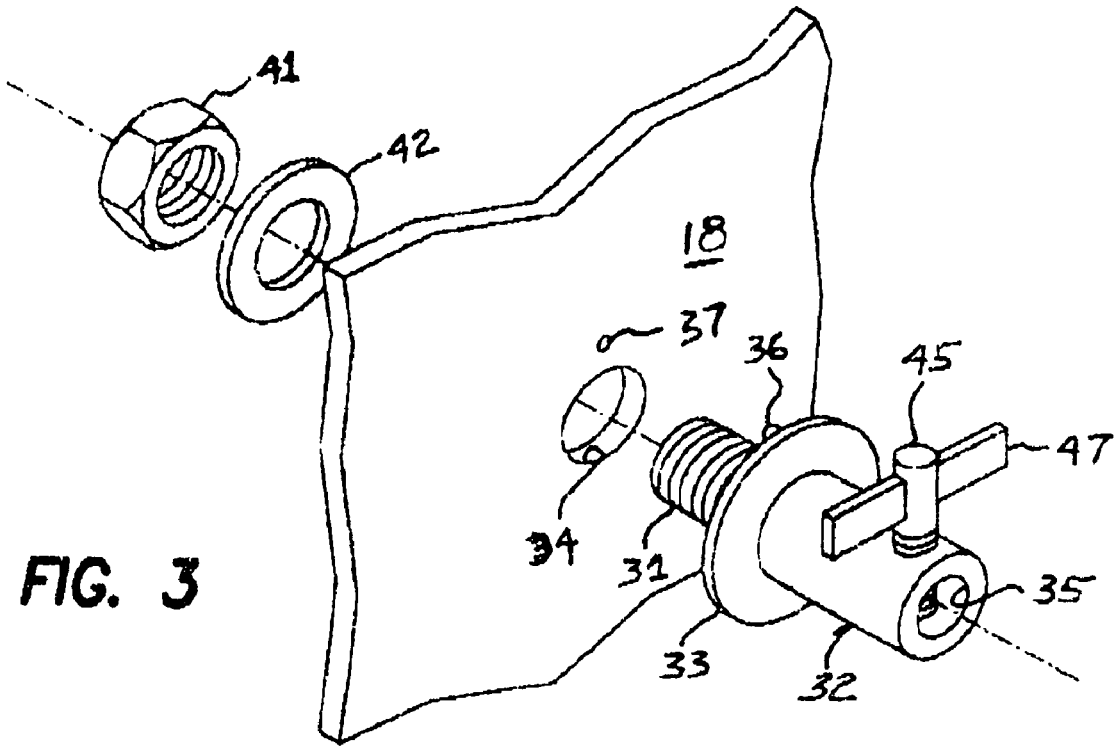
FIG. 3 is an exploded view of the mounting device shown in FIG. 2.
Figure 4:
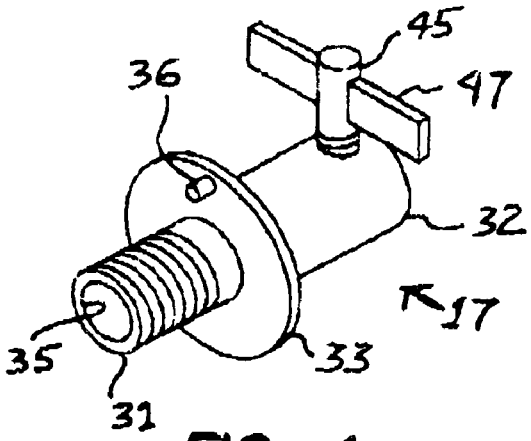
FIG. 4 is an unmounted perspective view of the mounting device.
Figure 5:
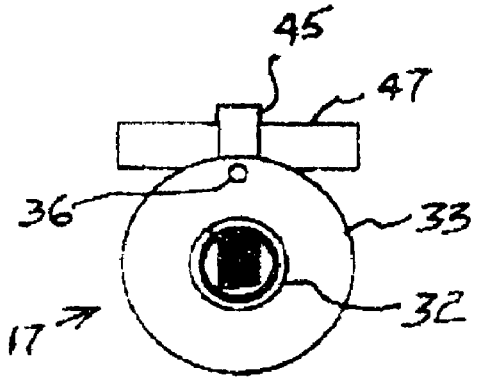
FIG. 5 is a front view of the mounting device of FIGS. 2–4.
Figure 6:
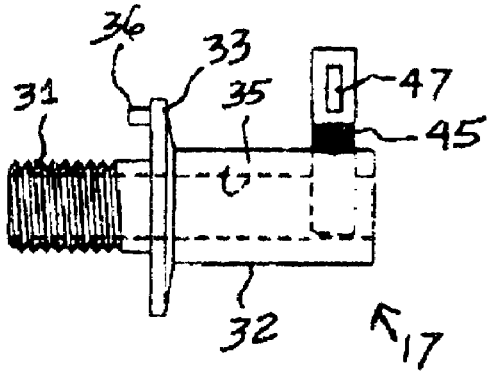
FIG. 6 is a side view of the mounting device of FIGS. 2–5.
Figure 7:
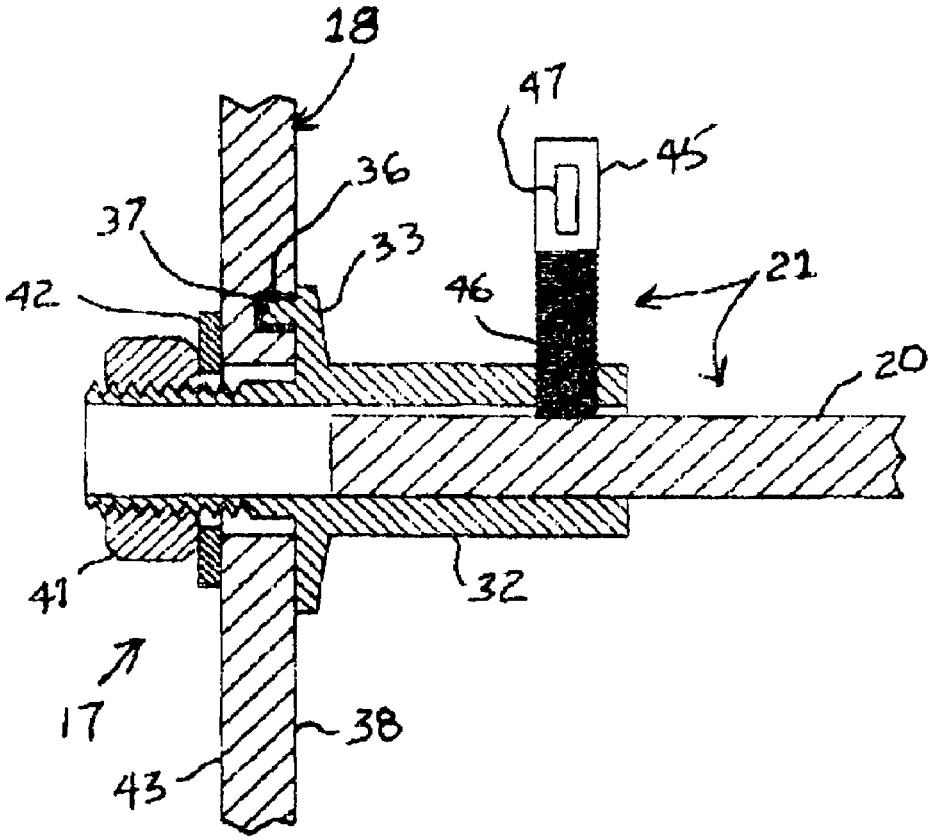
FIG. 7 is a cross-sectional view of the mounting device of FIGS. 2–6.

As shown in FIGS. 3–7, the elongated mounting device 17 has an externally threaded anchor portion 31 and a receiver portion 32 straddling by a collar portion 33. Extending through the anchor and receiver portions 31, 32 is a cylindrical bore 35. The anchor portions 31 extend through holes 34 in the drum shells 18 as depicted in FIG. 2. As also shown in FIG. 7, nipples 36 adjacent an outer edge of the collar portions 33 extend toward the anchor portions 31 and are received by cylindrical cavities 37 in an outer surface 38 of the bass drum shell 19.

Securing each mounting device 17 is a nut 41 which engages an anchor portion 31 and presses a washer 42 against an inner surface 43 of the bass drum shell 19. Each of the connector mechanisms 21 also includes a set screw 45 extending through a threaded aperture 46 in the receiver portion 32 of each mounting device 17. A handle 47 is attached to each set screw 45.

Prior to use of the system 11, the mounting devices 17 are attached to the drums 12–14 by inserting the anchor portions 31 through the openings 34 in the drum shells 18, 19 in a rotational alignment which inserts the nipples 36 into the cavities 37. The devices 17 then are secured by tightening the nuts 41. During this tightening operation, engagement of the nipples 36 and cavities 31 maintains a desired alignment of the devices 17 with the apertures 46 and handles 47 disposed in readily accessible upwardly facing positions above the receiver portions 32. The connector rods 20, 22 then are adjusted in the receiver portions 32 to establish desired spacing between the bass drum 12 and the drums 13, 14 and cymbal 15. Finally, the handles 47 are turned to tighten the set screws 45 and thereby retain the desired positions.

Obviously, many modifications and variations of the present invention are possible in light of the above teaching. It is to be understood, therefore, that the invention can be practiced otherwise than as specifically described.

What is claimed is:

1. A musical instrument comprising:

a drum having a shell defining at least one hole and a cavity adjacent thereto;

a mounting device including an anchor portion received by said one hole, a collar portion engaging said shell and defining a nipple projecting into said cavity so as to prevent rotation of said mounting device in said hole; and a receiver portion projecting externally from said shell and defining a bore receiving said connector mechanism;

securing means for securing said mounting device to said shell; and a connector mechanism for attaching a musical instrument to said mounting device.

2. A musical instrument system according to claim 1 wherein said receiver portion further defines an aperture; and said connector mechanism includes a rod received by said bore and a set screw extending through said aperture into engagement with said rod.

3. A musical instrument system according to claim 2 wherein said collar engages an outer surface of said shell, and said receiver portion projects externally thereof.

4. A musical instrument system according to claim 3 wherein said cavity and nipple are disposed so as to establish an upwardly facing position for said aperture.

5. a musical instrument system according to claim 4 wherein said connector mechanism further includes a handle projecting from said set screw.

6. A musical instrument system according to claim 5 wherein said anchor portion is threaded and said securing means comprises a nut rotatable on said anchor portion into contact with an inner surface of said shell.

7. A musical instrument system according to claim 1 wherein said shell defines a plurality of holes; and said system comprises a plurality of said mounting devices, one received by each of said holes, a securing means for securing each of said mounting devices, and a connector mechanism for attaching a musical instrument to each said mounting device.

8. A musical instrument system according to claim 7 wherein each said receiver portion further defines an aperture; and each said connector mechanism includes a rod received by a different one of said bores and a set screw extending through said aperture into engagement with each said rod.

9. A musical instrument according to claim 8 wherein each said collar engages an outer surface of said shell, and each said receiver portion projects externally thereof.

10. A musical instrument system according to claim 9 wherein each said cavity and nipple is disposed so as to establish an upwardly facing position for a said aperture.

11. A musical instrument system according to claim 10 wherein each said connector mechanism further includes a handle projecting from said set screw.

12. A musical instrument according to claim 7 wherein said musical instruments include a plurality of drums each having a shell defining a hole and a said mounting device with a receiver portion attached to a different one of said connector mechanisms.

13. A musical instrument system according to claim 12 wherein each said shell further defines a cavity disposed adjacent to each said hole, and each said collar defines a nipple projecting into a said cavity so as to prevent rotation of a said mounting device in a said hole.

14. A musical instrument system according to claim 13 wherein each said receiver portion further defines an aperture; and each said connector mechanism includes a rod received by a different one of said bores and a set screw extending through a said aperture into engagement with each said rod.

15. A musical instrument system according to claim 14 wherein each said collar engages an outer surface of a said shell, and each said receiver portion projects externally thereof.

16. A musical instrument system according to claim 15 wherein each said cavity and nipple is disposed so as to establish an upwardly facing portion for a said aperture.

17. A musical instrument system according to claim 16 wherein each said connector mechanism further includes a handle projecting from a said screw.

* * * * *